US005135621A

United States Patent [19]

de Nora et al.

[11] Patent Number: 5,135,621

[45] Date of Patent: Aug. 4, 1992

[54] COMPOSITE CELL BOTTOM FOR ALUMINUM ELECTROWINNING

[75] Inventors: Vittorio de Nora, Nassau, The Bahamas; Jean-Jacques Duruz, Geneva; Brian Cronin, Gland, both of Switzerland

[73] Assignee: Moltech Invent S.A., Luxembourg, Luxembourg

[21] Appl. No.: 466,366

[22] PCT Filed: Sep. 8, 1988

[86] PCT No.: PCT/EP88/00816

§ 371 Date: Mar. 15, 1990

§ 102(e) Date: Mar. 15, 1990

[87] PCT Pub. No.: WO89/02487

PCT Pub. Date: Mar. 23, 1989

Related U.S. Application Data

[63] Continuation-in-part of PCT/US87/02357, Sep. 16, 1987, abandoned.

[51] Int. Cl.[5] ..... C25C 3/08

[52] U.S. Cl. ..... 204/67; 204/243 R; 204/294

[58] Field of Search ..... 204/67, 243 R-247, 204/294

[56] References Cited

U.S. PATENT DOCUMENTS

| | | | |
|---|---|---|---|
| 3,093,570 | 6/1963 | Dewey | 204/243 |
| 3,287,247 | 11/1966 | Dewey | 204/243 |
| 3,370,071 | 2/1968 | Patchett et al. | 260/397.4 |
| 3,390,071 | 6/1968 | McMinn et al. | 204/243 |
| 3,457,158 | 7/1969 | Bullough | 204/243 |
| 3,960,696 | 6/1976 | Wittner | 204/243 R X |
| 4,392,925 | 7/1983 | Alder et al. | 204/67 X |
| 4,505,796 | 3/1985 | Huni et al. | 204/243 M |
| 4,540,475 | 9/1985 | DeAngelis | 204/67 |
| 4,592,820 | 6/1986 | McGeer | 204/243 R |
| 4,612,103 | 9/1986 | Dewing et al. | 204/243 R |
| 4,613,418 | 9/1986 | Dewing et al. | 204/243 R |
| 4,619,750 | 10/1986 | Bessard | 204/243 R |
| 4,673,481 | 6/1987 | Scharpey | 204/243 R |
| 4,737,254 | 4/1988 | Gesing et al. | 204/243 R |
| 4,795,540 | 1/1989 | Townsend | 204/294 X |
| 4,877,507 | 10/1989 | Hudson et al. | 204/243 R |

FOREIGN PATENT DOCUMENTS

| | | |
|---|---|---|
| 0215590 | 8/1986 | European Pat. Off. . |
| 2318599 | 12/1977 | Fed. Rep. of Germany . |
| 1206604 | 9/1970 | United Kingdom . |
| 2076021 | 11/1981 | United Kingdom . |

*Primary Examiner*—Donald R. Valentine
*Attorney, Agent, or Firm*—John J. Freer

[57] ABSTRACT

A cell for the electrowinning of aluminum from molten salts has a cell bottom lining consisting partly of a refractory mass (4) and partly of carbon bodies (5). At least 30% and preferably 50% or more of the cell bottom area is occupied by the refractory mass (4). The carbon bodies (5) are level with the refractory mass (4) or are recessed therein.

26 Claims, 6 Drawing Sheets

COMPOSITE CELL BOTTOM FOR ALUMINUM ELECTROWINNING

CROSS REFERENCE TO RELATED APPLICATION

This application is a continuation-in-part of prior application PCT/US87/02357 filed Sep. 16, 1987.

TECHNICAL FIELD

The invention relates to aluminum reduction cells of the type having a cell bottom comprising a carbon body through which current is supplied to a pool of molten aluminum resting on the cell bottom, as well as to methods of fabricating and assembling such cells and methods of producing aluminum by electrolysis of a molten salt containing a dissolved aluminum compound in particular molten cryolite containing alumina, using an improved cell of this type.

BACKGROUND ART

Conventional Hall-Heroult cells for the electrolytic production of aluminum employ a carbon cell bottom which serves to supply current to a deep pool of molten aluminum forming the cathode. The cathodic aluminum is necessarily thick (at least 80–100 mm) because carbon is non-wettable by molten aluminum and during operation would not completely cover the carbon if the aluminum layer were thinner. In the conventional arrangement, a horizontal steel conductor bar is embedded in the lower part of the carbon cell bottom for the supply of current from an external source. Thus, the entire cell bottom in contact with the molten aluminum cathode consists of carbon which, in operation, is impregnated with sodium species and other ingredients of the cryolite leading to the formation of toxic compounds including cyanides. Despite the many disadvantages associated with carbon as cathode current feeder material (non-wettability by aluminum, necessitating deep pool operation; the relatively high electrical resistance of carbon, leading to energy losses; reactions within the cell environment necessitating disposal of large quantities of contaminated carbon when the cell bottom is renewed; swelling, which must be compensated by supporting the cell sidewalls in cradles, etc), attempts to replace carbon with theoretically more advantageous materials and employing new cell designs have not so far met with success.

Thus, for example, an aluminum production cell having an electrically non-conductive refractory lining with a "bottom entry" current collector is described in U.S. Pat. No. 3,287,247. The inner end of the current collector has a cap of $TiB_2$ projecting into a depression containing a deep pool of molten aluminum. U.S. Pat. No. 3,321,392 describes a similar arrangement in which the protruding ends of $TiB_2$ conductor bars are rounded. U.S. Pat. Nos. 3,093,570 and 3,457,158 disclose similar designs in which bottom-entry cylindrical current collector bars or posts of $TiB_2$ or graphite extend through a non-conductive refractory lining consisting throughout of powders of alumina and cryolite or aluminum fluoride.

U.S. Pat. No. 4,613,418 has proposed an aluminum production cell with an alumina potlining in which bottom-entry current collectors are embedded and extend to a recess in the potlining. To prevent the unwanted collection of sludge in these depressions, this patent proposes filling the depressions with balls of aluminum-wettable material. Related designs are proposed in U.S. Pat. No. 4,612,103.

These alternative cell designs, using a non-carbon cell bottom, have great promise. Replacement of the carbon cell bottom with, e.g., alumina leads to potential savings in materials and operating costs. However, such proposals heretofore have generally relied on the use of a family of materials known as Refractory Hard Metals ("RHM") encompassing the borides and carbides of metals of Group IVB (Ti, Zr, Hf) and VB (V, Nb, Ta) of the periodic table of the elements. $TiB_2$ has been identified as the most promising RHM material. The use of these materials as part of the current supply arrangement has encountered a number of problems including cost and the difficulty of producing and machining large pieces of the materials. Such difficulties have led to the design expedients proposed in the aforementioned U.S. Pat. Nos. 4,613,418 and 4,612,103, where, for example, small pieces of $TiB_2$ are assembled or packed together in an environment of molten aluminum as part of the current supply arrangement.

The problems experienced with RHM current collectors and further expedients for dealing with them, namely the provision of a protective barrier incorporating a molten fluoride- or chloride-containing salt mixture or a getter such as particulate aluminum, are further described in EP-A-0 215 555.

In addition to the problems associated with the use of RHM materials, the cell design employing multiple current collector bars or posts of relatively small cross-section penetrating through the cell lining has many inherent drawbacks since each current collector must carry a high current and the failure of any single current collector can lead to a total cell failure.

A number of proposals have been made for alternative cell designs having carbon cell bottoms in conjunction with inert materials underneath and/or at the sides of the carbon. See, for example, U.S. Pat. Nos. 3,390,071, 4,592,820, 4,673,481 and 4,619,750. Side-entry current feeder designs have also been proposed, e.g. in U.S. Pat. No. 3,370,071, but such designs have not found acceptance on account of a number of inherent drawbacks. There has been also a proposal in UK-A-2 076 021 to provide dividers of insulating material that subdivide the liquid aluminum cathode so that its effective surface area is somewhat less than that of facing dimensionally stable anodes, with a view to improving the anode lifetime. This arrangement, however, complicates the cell bottom and adds to its cost.

UK-A-1 206 604 has disclosed carbon blocks which protrude above a cell lining for the purpose of collecting sludge on the cell bottom. This design is, however, confined to deep pool operation and the protruding carbon elevations are subject to erosion.

The problems associated with replacing the carbon bottoms of aluminum reduction cells have thus not been resolved in a satisfactory manner, so that carbon cell bottoms continue to be the industry standard.

DISCLOSURE OF INVENTION

This invention is based on the realization that considerable savings can be made and other advantages obtained by replacing substantial portions of the carbon in the cell bottom by refractory materials in areas where the carbon was considered necessary to provide for an adequate supply of current to the pool of aluminum forming the cathode.

The invention therefore provides a cell for the electrowinning of aluminum from molten salts utilizing carbon cathodes, in which the cell bottom lining consists partly of a refractory mass and partly of carbon, the total upwardly facing surface area of the carbon cathode under the anode being smaller than the horizontal surface area of the anode.

In this description: "projected anode area" or "horizontal surface area of the anodes" mean the surface area of the cell bottom defined by a line bounding the periphery of each anode projected onto the cell bottom. Also, it is understood that the term "carbon cathode" means the carbon cathode current feeder, since the carbon acts to supply current to the pool of molten aluminum which forms the effective cathode in the cell.

According to the invention, a cell for the electrowinning of aluminum from molten salts of the type having a plurality of anodes disposed over a cell bottom comprises a carbon cathode through which current is supplied to a pool of molten aluminum on the cell bottom, and is characterized in that the cell bottom is lined with at least one body of carbon and at least one mass of non-conductive, refractory material juxtaposed with the carbon body or bodies to make up a composite cell bottom composted of adjacent areas of current-conducting carbon and non-conducting refractory material, the upper surfaces of the carbon areas being located at the same level as or lower then the upper surfaces of the refractory areas, and the total upwardly facing surface area of the carbon in the cell bottom located under the anodes being smaller than the horizontal surface area of the anodes.

In these cells, at least a part of the surface area of the anodes projected on the cell bottom thus covers areas of the non-conducting refractory material. Typically, 20% or more of the projected anode area will be occupied by the refractory material and in some embodiments the entire anode surface area projected onto the cell bottom is occupied by the refractory material. This is possible by locating the carbon cathodes so that they provide an adequate distribution of current to the cathodic pool of molten aluminum. The pool of aluminum itself is such a good electrical conductor that current is evenly distributed at the surface of the pool. By thus replacing a substantial fraction of the carbon (as compared to a conventional carbon cell bottoms) considerable advantages are achieved, including:

- initial materials cost saving of the amount of block carbon required.
- a considerable reduction of the amount of contaminated carbon to be disposed of when the cell bottom is renewed, this contaminated carbon being a non-reusable hazardous waste.
- possible capital saving by reducing the production of the block carbon.
- by eliminating carbon pastes currently used to cement the carbon blocks, exposure of the workers to the fumes is eliminated.
- longer average cell life because of reduction of the swelling of the carbon blocks and replacement by a non-swelling refractory material.
- because of this reduction of swelling, there is less pressure on the sides of the cell. Consequently, the number of cradles or other devices to support the cell sidewalls is reduced, further simplifying construction of the cell and enabling a significant capital saving.
- when the cell is shut down and re-rebuilt, the alumina or other refractory material can be ground and re-used. This entails a significant saving in raw materials (cryolite) absorbed by the refractory because these materials can now be recycled whereas with all-carbon cell bottoms, such absorbed materials are lost with the hazardous waste.
- reduction of the manpower and time to construct or re-line a cell.

Furthermore, this new composite cell bottom is relatively inexpensive, easy to construct, composed of tried and tested materials whose performance in the cell environment is known, and suitable for retrofit of existing cells but can also be applied to new cell designs. In these cells, preferably at least 30% and often 50% or more of the surface area of the carbon cell bottom lining is replaced by a refractory mass. Usually, no more than 80 or at most 90% of the surface area of the cell bottom is made up of the refractory mass, depending on the geometrical configuration. Also, as a general rule, the upwardly-facing carbon cathode area will be less than 50% of the active anode surface area, i.e., its horizontal area plus the operative area of the sides.

In most embodiments, the refractory mass extends to the cell sides. The refractory mass advantageously comprises tabular alumina, for example it may be a mixture or layers of tabular alumina and alpha alumina as disclosed in EP-A-0 215 590, but may also consist at least in part of fused alumina, e.g., slabs of fused alumina forming the upwardly-facing surface of the cell bottom. The upper surface of the refractory mass may be wettable by molten aluminum, e.g., by incorporating aluminum-wettable RHM materials.

The level of the refractory mass, i.e., its upper surface, can be at the same level as the surface of the carbon cathode. In preferred embodiments, however, the level of the refractory mass is higher than the level of the carbon cathode. In this way, the depth of the pool of molten aluminum above the refractory mass can be reduced while maintaining this level sufficiently above the carbon cathode to protect the carbon from contact with the electrolyte during fluctuations of the pool level. Thus, when the level of the carbon cathode is below the level of the refractory mass, this permits a shallow aluminum pool above the refractory mass thereby reducing the fluctuation of the molten aluminum. This in turn permits the electrode gap to be reduced thanks to reduced fluctuation of the molten pool.

The carbon cathode can consist of a plurality of sections usually of rectangular shape (in order to reduce the effect of the magnetic field and the fluctuation of the molten aluminum pool). These carbon cathode sections are longitudinal in the cell, or transversal. Alternatively, the carbon cathode sections in the cell are placed under the anodes and are of rectangular, round or of any convenient shape. In some embodiments, the carbon cathode sections in the cells are not placed in correspondence of the anodes and are of rectangular or round or of any other convenient shape. One particularly advantageous configuration which will be described later consists of a chequer pattern.

The areas of carbon may be rectangular (in plan view) and the refractory mass can occupy a space made up by multiples of the rectangular spaces corresponding to the carbon cathodes. Usually both the carbon and the refractory mass extend down to the cell lining or other support surface of the cell bottom, but this is not necessary and in some embodiments the carbon bodies may extend only part of the way down and be supported in a recess in the refractory mass.

Electrical contact of the carbon cathode to the external bus bars can be made through conventional horizontal collector bars, i.e., usually transverse in relation to the cell, but other arrangements are possible in new cell designs.

Vertical pins, plates or bars of metals resisting the operating temperature of the cell may be inserted in the carbon cathode and connected to the collector bars, so reducing the electrical resistivity of the carbon bodies. Such pins, plates or bars may alternatively be connected to the conductive outer shell of the cell and from there to the bus bars.

The surface of the carbon cathodes in contact with the molten aluminum may also be increased by providing cuts, holes, slots or other recesses in the carbon body extending vertically but not reaching the current collecting means and filled with aluminum. Furthermore, spacings (slots) can be provided between the carbon cathodes and the adjacent refractory mass, these spacings or slots extending vertically and being filled with aluminum, but not reaching the current collecting means.

A feature of the described cells is that the cell bottom contains no portions of carbon which are not in contact with the molten aluminum. In the cells according to the invention, all the carbon serves as current feeder. There is no carbon which serves merely as a cell lining.

The cell according to the invention can operate with conventional pre-baked carbon anodes or with oxygen evolving anodes, such as dimensionally stable anodes having a cerium oxide-fluoride surface coating.

A method of fabricating or renovating (retrofitting) an aluminum production cell bottom according to the invention consists of lining the cell bottom with a refractory mass and carbon, the total upwardly-facing surface area of the carbon cathode located under the anode locations being smaller than the projection of the horizontal area of the anodes to be fitted in the cell, the upper surfaces of the carbon blocks being located at the same level as or lower than the upper level of the mass of refractory material. Advantageously, the carbon may be blocks of the same shape and size as the rows of carbon blocks in an existing cell, certain of these blocks being replaced in a retrofit operation with a mass of refractory material such as alumina.

The invention also relates to the production of aluminum e.g. by the electrolysis of alumina in molten cryolite, using the improved cell as described herein.

BRIEF DESCRIPTION OF DRAWINGS

The invention will now be further explained with reference to the accompanying schematic drawings, in which.

DESCRIPTION OF PREFERRED EMBODIMENTS

Figure 1:
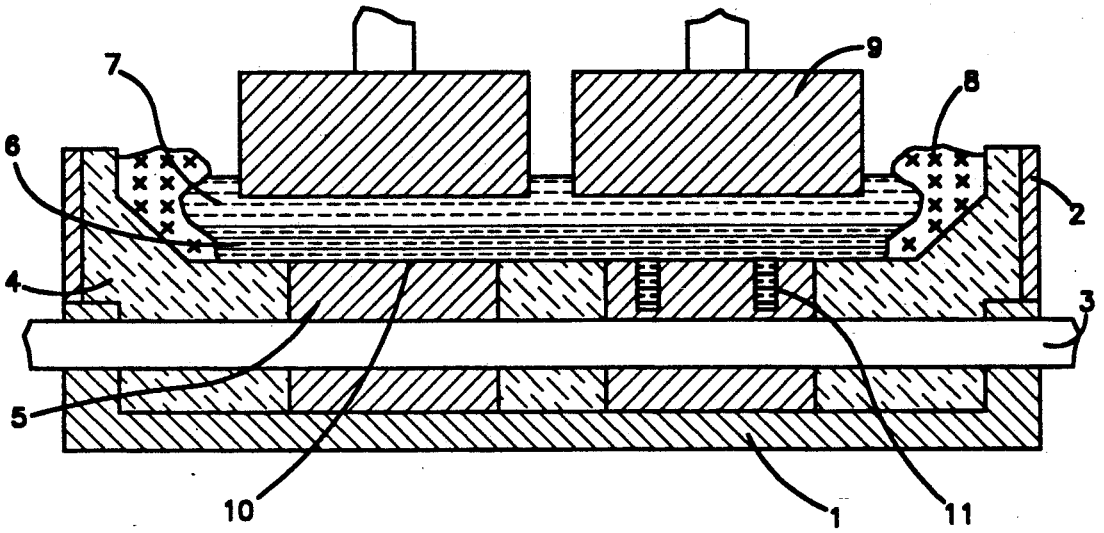
FIG. 1 is a transverse cross-section through an aluminum electrowinning cell showing different forms of the cell bottom according to the invention.

FIG. 1 is a transverse cross-section through a Hall-Heroult cell of generally traditional design except that it has been retrofitted with an improved cell bottom according to the invention. The cell comprises a heat insulating shell 1, 2 having transverse cathode current-feeder bars 3 for example of steel or other suitable high-temperature resistant alloy. This shell 1, 2 contains a cell bottom made up of a mass 4 or compacted inert refractory material such as alumina and carbon bodies 5. The current-feeder bars 3 pass through the carbon bodies 5 for the supply of electric current to a pool 6 of molten aluminum resting on the top surface of the cell bottom. On top of the molten aluminum pool 6 is a layer of molten electrolyte 7, for example cryolite containing up to about 10% of alumina at a temperature of about 900°-970° C. The electrolyte 7 is surrounded by a freeze 8 of solidified electrolyte which covers the top edges of the refractory mass 4 and also extends around the periphery of the molten aluminum pool 6. Into the electrolyte 7 dip two rows of pre-baked carbon anodes 9 suspended by a conventional anode suspension arrangement (not shown).

In traditional Hall-Heroult cells, the cell bottom (i.e., corresponding to parts 4 and 5) is composed substantially entirely of carbon. The improved cell, as shown, having a mass 4 of refractory material making up a major part of the cell bottom, can conveniently be constructed as a retrofit operation when the existing carbon cell bottom must be replaced.

The carbon bodies 5 shown in FIG. 1 lie under the anodes 9 but the upwardly-facing surface area of the carbon bodies 5 under the anodes is less than the projected area of the anodes 9. Various configurations of how the bodies 5 may be disposed in the cell bottom and how the anodes 9 project onto the top face of the cell bottom will be described later.

Figure 2:
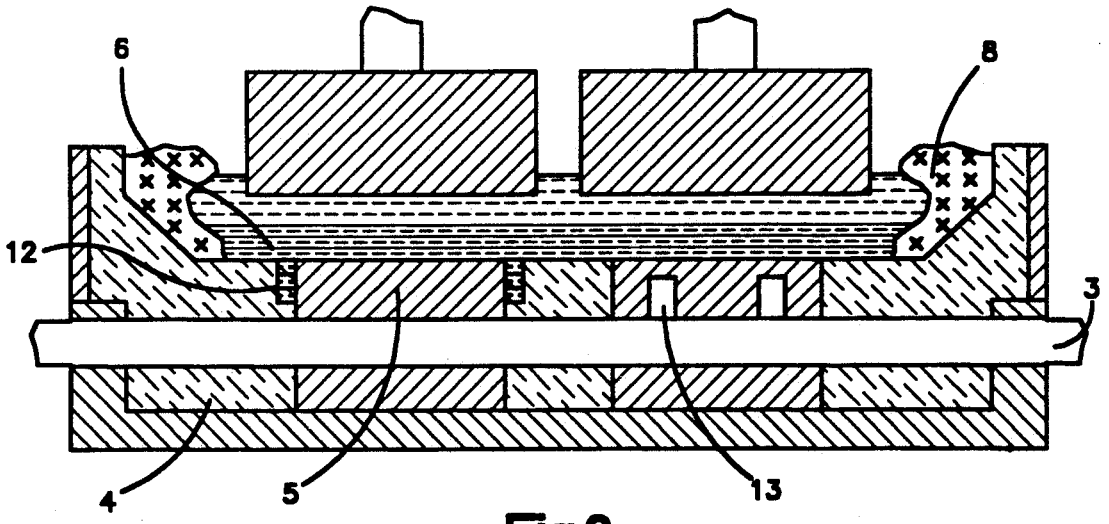
FIGS. 2-3 are views similar to FIG. 1 illustrating further forms of the cell bottom.

FIG. 1 shows two different arrangements for the upper faces of bodies 5. The left-hand body 5 has a flat top face 10 flush with the flat top face of the refractory mass 4, thus making up a flat uninterrupted cell bottom covered by the molten aluminum poll 6. The right-hand body 5 has two slots 11 machined into its upper face and extending down to within several centimeters of the current-feeder bars 3. These slots 11 are made wide enough so that they fill u p with molten aluminum from the pool 6. A single slot 11, or more than two slots could be provided, as convenient, or instead of slots there could be recesses of any other suitable shape, e.g., with a round cross-section. The purpose of these slots or other recesses is to reduce the current carrying path between the bars 3 and the aluminum pool 6, thereby avoiding energy loss the due to the relatively low electrical conductivity of carbon. It is understood that all of the carbon bodies 5 in the cell bottom will usually be identical, i.e., all as shown int he left of FIG. 1 or all as shown in the right of FIG. 2. The same comment applies also to FIG. 2.

For convenience, in the remaining Figures, like reference numerals designate the same parts as in FIG. 1.

The cell shown in FIG. 2 is the same as that shown in FIG. 1 except for details of the current supply arrangement for the carbon bodies 5. Adjacent the left hand carbon block 5 are channels 12 in the refractory mass 4. These channels 12 end several centimeters above the current-collector bars 3 and are filled with molten aluminum from the pool 6. Again, this serves to reduce the current-carrying path between the bars 3 and pool 6. Conveniently, the walls of the mass 4 forming channels 12 may be lined with an aluminum-wettable material such as $TiB_2$ or a composite containing $TiB_2$.

The right-hand part of FIG. 2 shows a carbon block 5 incorporating a series of plates or posts 13 upstanding on the bars 3. The bars 3 and posts 13 may both be of steel or a weldable alloy such as NiAl, and joined by welding. These plates or posts 13 extend upwardly in the blocks 5 but stop several centimeters short of their upper faces. Any convenient number of plates or posts 13 can be provided. This is thus another way of reducing the current-carrying path through the carbon of blocks 5.

Various combinations can be made of the features shown in FIGS. 1 and 2. For example, the plates or posts 13 can be combined with external channels 12; or the external channels 12 can be combined with slots 11.

Figure 3:
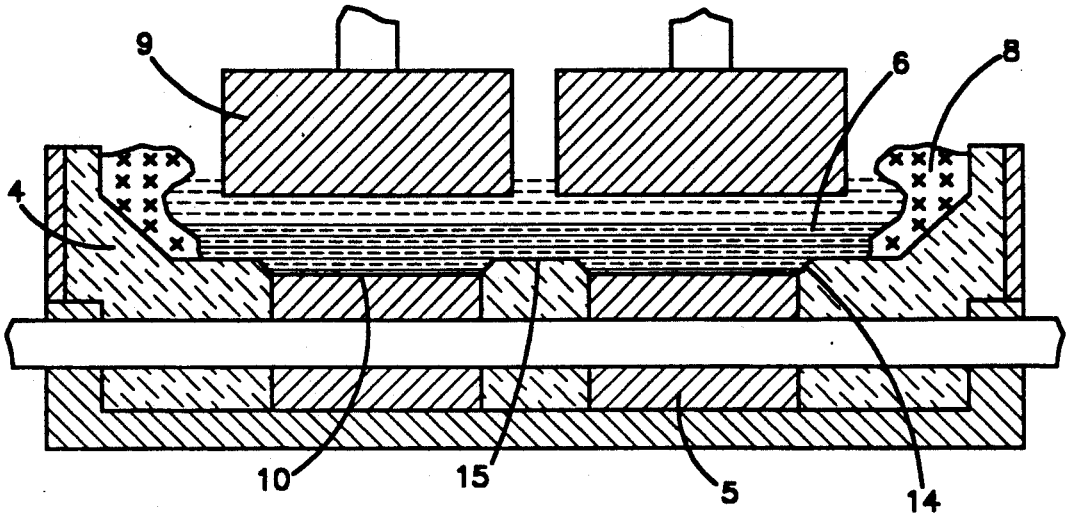

In the cell illustrated in FIG. 3, the carbon bodies 5 are located in recesses 14 in the cell bottom so that the top face 10 of bodies 5 is below the top 15 of the refractory mass 4, which has bevelled edges extending down to the top face 10 of bodies 5. By using this arrangement, it is possible to lower the upper level of the pool 6 and, in turn, reduce the gap between the anodes 9 and pool 6.

Figure 4:
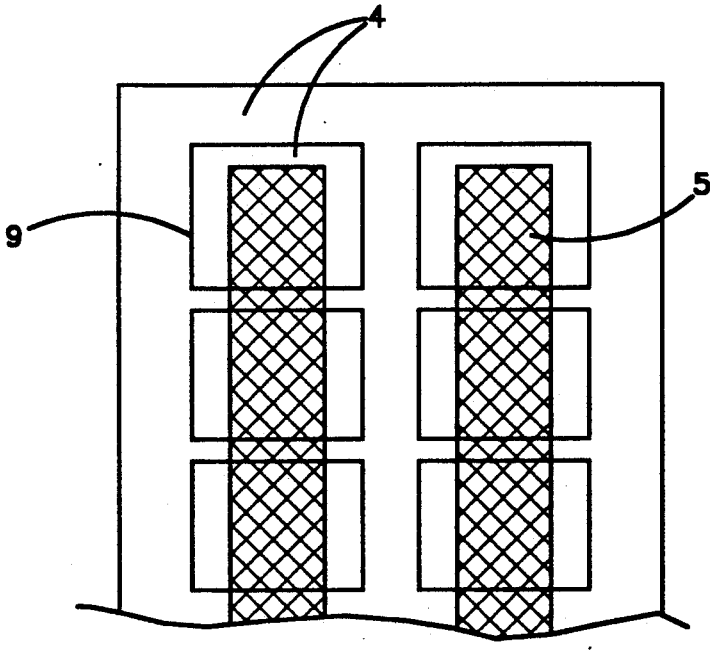
FIG. 4 is a diagrammatic plan view of one form of a cell bottom as shown in FIGS. 1-3.

FIG. 4 is a schematic plan view showing one possible arrangement of how the anodes 9 are disposed over the central flat part of the cell bottom made up of the refractory mass 4 and carbon bodies 5. For convenience, optional features such as the slots 11, channels 12 and recesses 14 are not shown. The current-collector bars 3 which protrude laterally from the cell are also not shown. The anodes 9 are represented in outline, i.e., as projected onto the cell bottom. FIG. 4 shows carbon bodies 5 extending as two side-by-side longitudinal strips along the cell and located under the two rows of anodes 9. These anodes 9 have the same shape, dimensions and location as in a conventional cell. The projection of each anode 9 on the cell bottom extends in part over the refractory mass 4 which occupies a major part of the cell bottom area. In this particular embodiment, the carbon bodies 5 are located partly under the anode projections 9.

Figure 5A:
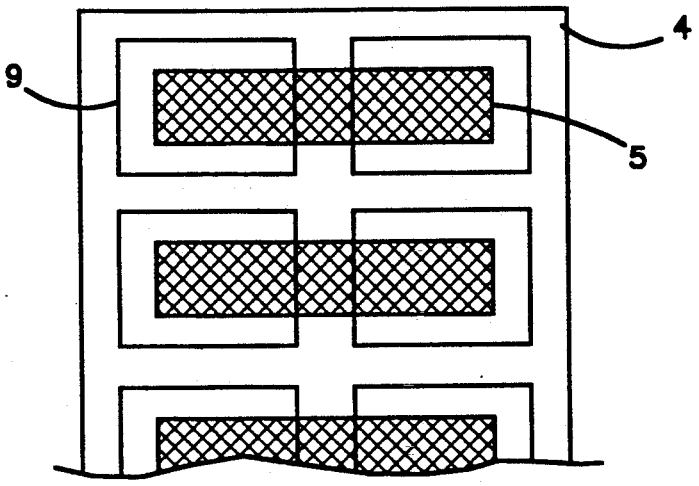
FIGS. 5A, 5B and 5C are views similar to FIG. 4 showing different cell bottoms.
Figure 5B:
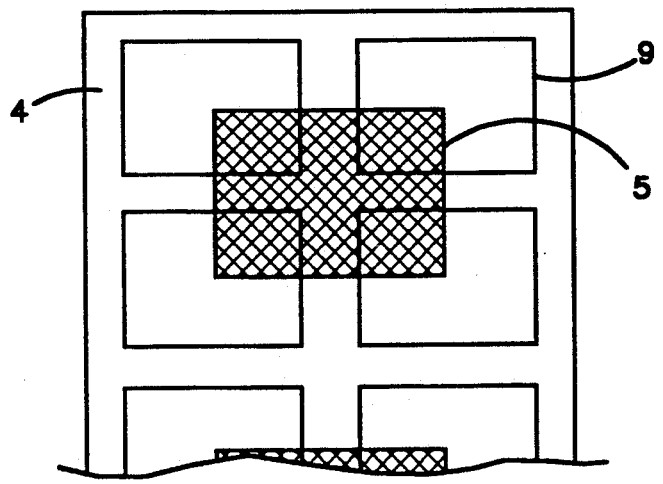
Figure 5C:
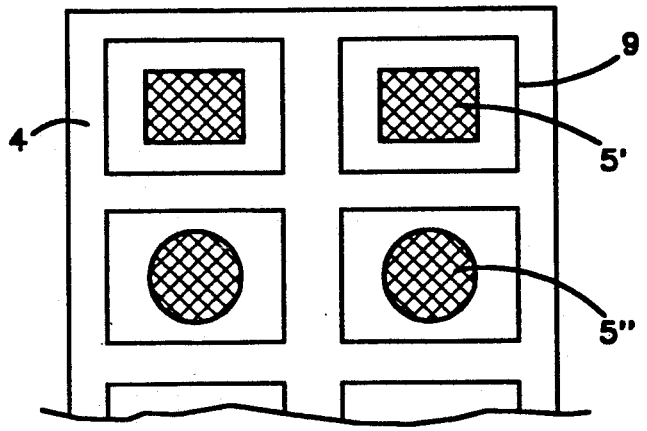

FIGS. 5A, 5B and 5C show three different configurations in which the carbon bodies 5 also extend partly under each anode projection.

In FIG. 5A, transverse carbon bodies 5 are located under each side-by-side pair of anodes 9. In FIG. 5B, a rectangular or square carbon body 5 is located centrally under a cluster of four anodes 9. In FIG. 5C, a single carbon body 5 is located centrally under each anode 9; two of these bodies 5' are shown as square and two others 5'' of circular shape. However other shapes are possible. As for the other embodiments, the anodes 9 project onto the refractory mass 4. In the illustrated examples, the refractory mass 4 occupies approximately the following percentages of the projected anode area: 47% in FIG. 4, 51% in FIG. 5A, 76% in FIGS. 5B and 70%/66% in FIG. 5C FIGS. 6A–6F are schematic diagrams of the cell bottom shown subdivided into rectangles each representing the location of a carbon block 5 in a conventional cell bottom to be replaced. In the conventional procedure, the carbon blocks 5 are bonded at their interfaces by carbon pastes which release hazardous fumes. By reducing the number of these interfaces, and in some cases even by eliminating them, an important advantage is obtained. For convenience, these interface lines are shown in FIGS. 6A–6F even at the locations occupied by a monolithic refractory mass, e.g., of packed alumina.

FIGS. 6A–6D illustrate a cell bottom previously made up of rows of four rectangular carbon blocks 5 and in which some of the carbon blocks have been replaced. Typically each transverse row of four carbon blocks is associated with a transverse current feeder bar (not shown), like the bar 3 on FIG. 1. In the retrofitted cell bottom of the invention shown in FIG. 6A, all of the carbon blocks along the sides and ends of the cell are replaced by a refractory mass 4. This leaves a central longitudinal cathode made up of carbon bodies 5.

Figure 6A:
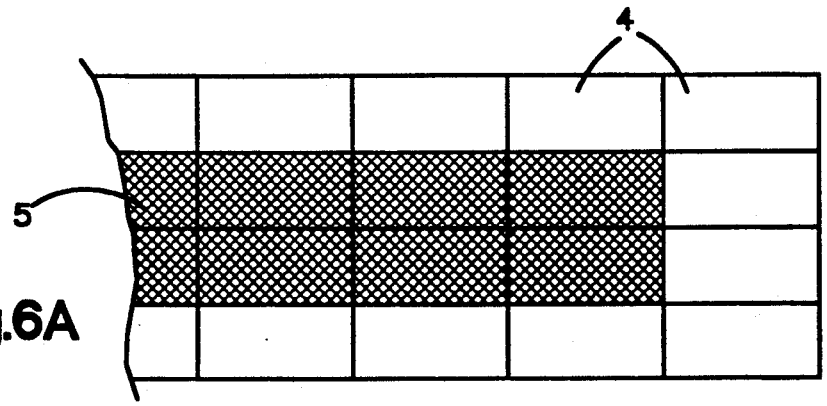
FIGS. 6A-6F are diagrammatic plan views of other cell bottom configurations.
Figure 6B:
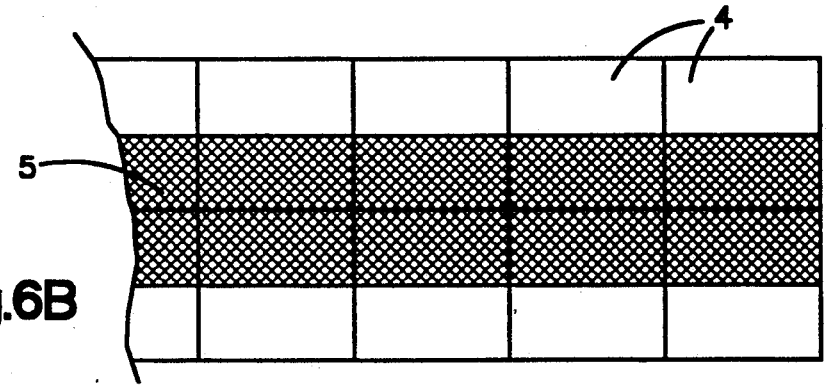

The arrangement shown in FIG. 6B is similar to that in FIG. 6A, except that only the lateral carbon bodies are replaced with the refractory mass 4, so that the carbon cathode made of bodies 5 extends from end-to-end of the cell.

Figure 6C:
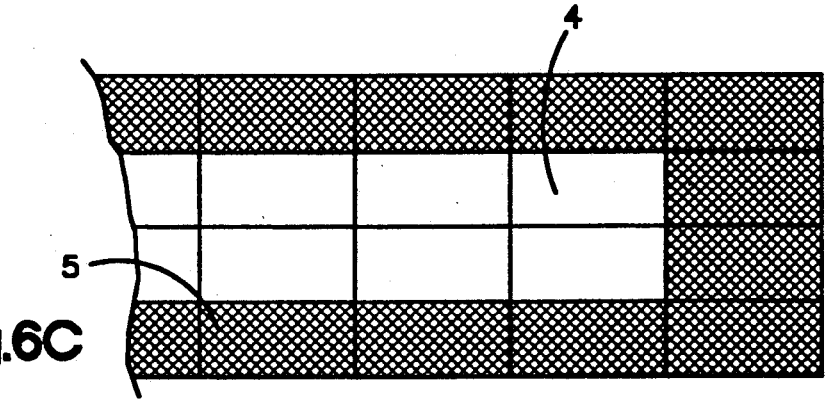

FIG. 6C shows an inverse a arrangement where the carbon bodies 5 are arranged around the periphery of the cell bottom, leaving a rectangular central opening filled with the refractory mass 4.

Figure 6D:
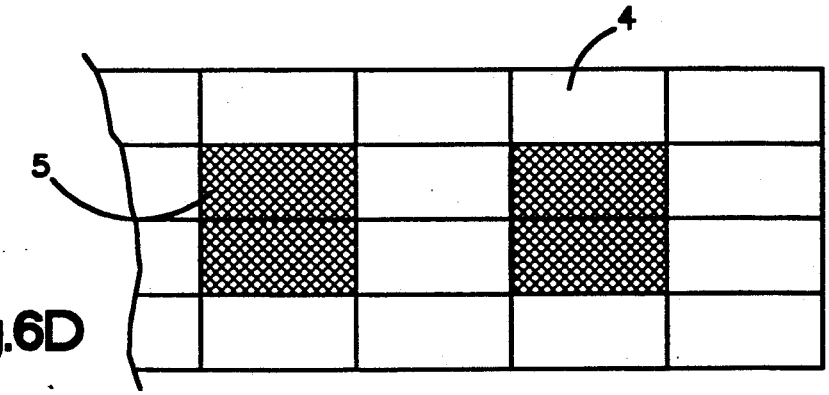

FIG. 6D shows how substantially square cathodes can be made up (cf. FIG. 5B); in this example, the surface area of the carbon block 5 is less than ¼ of the cell bottom area.

Figure 6E:
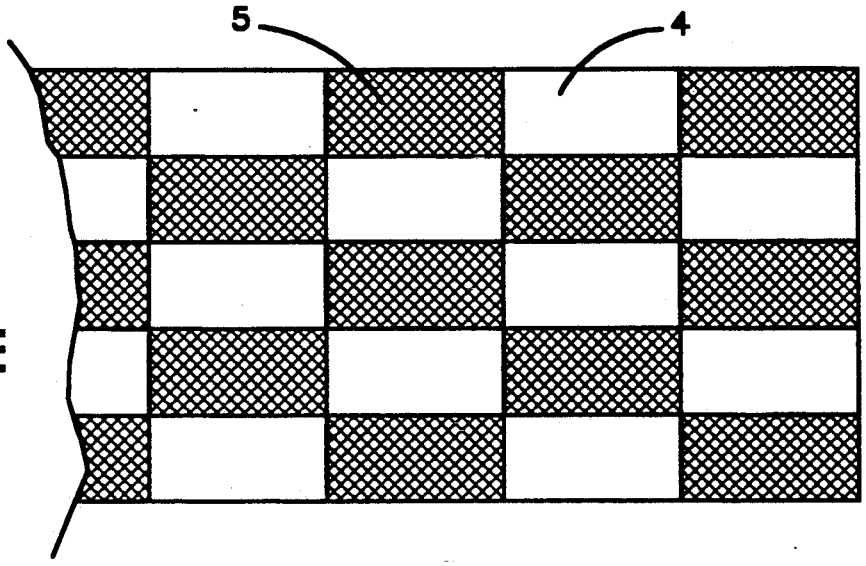
Figure 6F:
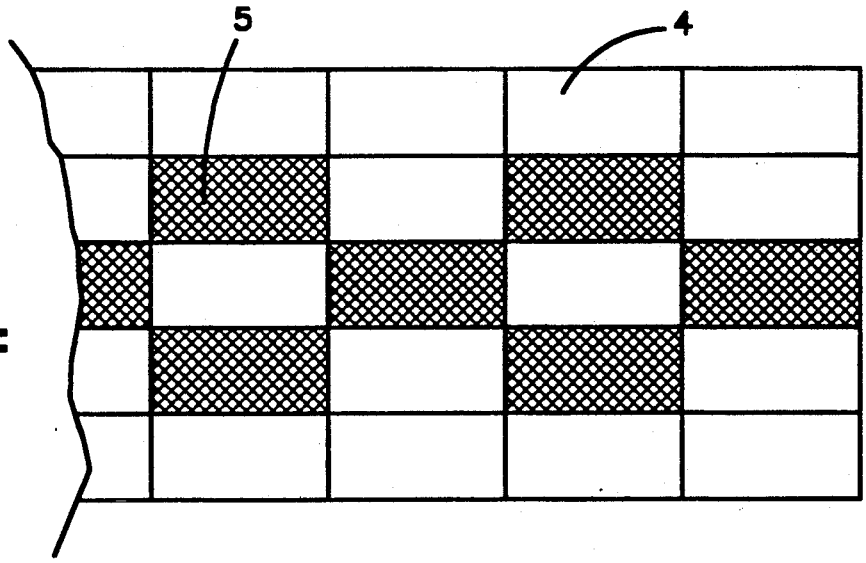

FIGS. 6E and 6F show further cell bottom configurations possible for retrofitting a cell made up of rows of five carbon blocks. FIG. 6E shows a checkerboard design obtained by replacing alternate carbon blocks 5 by the refractory mass 4. This design has two significant advantages. Firstly, a very uniform current distribution can be obtained using all of the existing cathode current connector bars. Secondly, there are no interfaces between the carbon blocks thereby eliminating the need for bonding with carbon paste.

FIG. 6F shows a similar checker arrangement in which even more carbon is replaced, i.e., around the periphery of the cell bottom.

Obviously, many more designs are possible for the cell bottom, depending on the size and shape of the carbon blocks for any given cell bottom. Also, in FIGS. 6A–6F the locations of the anodes are not shown. It is evident that the cell bottom configuration can be set up as a function of a given anode configuration (rows of one, two or three anodes) if desired.

For a retrofit operation, it is clearly advantageous to design a cell bottom based on the dimensions of the existing carbon blocks. In this way, the existing production line for the carbon blocks can be used without modification. In some cases it may however be advantageous to use smaller carbon blocks, either using a modified production line or by cutting the blocks in halves, or quarters, etc.

The cell bottoms illustrated in FIGS. 5A–5C and 6A–6F may have a planar top face, i.e., with the top of the carbon blocks 5 flush with the top of the refractory mass 4. This arrangement is particularly suitable for operation with a deep pool of molten aluminum. Alternatively, for operation with a deep pool or a relatively shallow pool of molten aluminum, the top surface of the refractory mass 4 can be made wettable by molten aluminum, e.g., by incorporating RHM materials, and the carbon blocks 5 can be recessed so that their top surfaces are below the aluminum-wettable top surface of the refractory mass 4. In this way, thee are deeper pools of molten aluminum over the carbon bodies 5, sufficiently deep to protect the carbon bodies from attack by the electrolyte, e.g., during fluctuation of the level of the pool of molten aluminum. This recessed or stepped configuration is also very advantageous in that by having confined in the aluminum pool are damped, permitting operation with a narrow gap between the anodes and the aluminum pool. These recessed embodiments may advantageously employ tiles or slabs of fused aluminum containing RHM inclusions in their surface, as described in copending application now U.S. Pat. No. 5,004,524 and as illustrated in FIG. 7.

Figure 7:
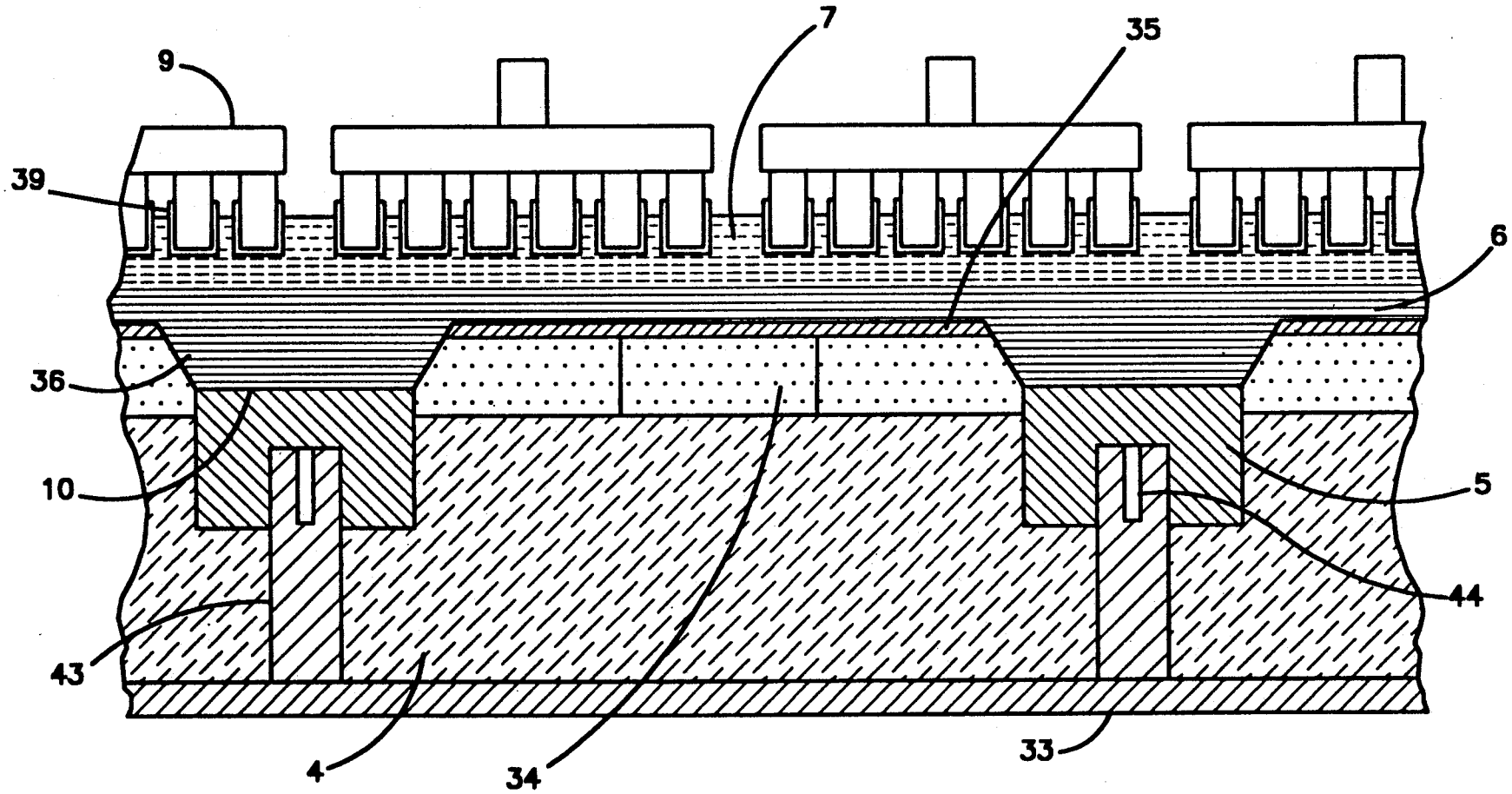
FIG. 7 is a longitudinal cross-sectional view through part of another cell.

FIG. 7 is a longitudinal cross-section through part of another aluminum electrowinning cell employing carbon bodies in the form of bars 5 in a recessed shallow-pool configuration. The cell has a conductive base plate 33 e.g. of steel to which the bars 5 are connected by steel or other alloy plates or posts 43 having slots 44 in their upper ends to accommodate for expansion. In this example, the bars 5 do not extend right down to the base plate 33 but are contained in recesses in the refractory mass 4. On top of the alumina or other refractory mass 4 are blocks 34 of refractory material having an upper layer 35 of RHM, for example $TiB_2$ particles or lumps embedded in a layer of tabular alumina or in fused alumina as described in greater detail in copending application now U.S. Pat. No. 5,009,424. The top of refractory mass 4 is just below the level of the top 10 of the carbon bars 5, and the blocks 34 are placed alongside the bars 5 whereby they provide a recess 36 which is filled with molten aluminum 6. The walls of the recess 36 can be sloping, as shown, or vertical. Thus, the molten aluminum 6 forms a shallow pool or film about 3–30 mm thick above the aluminum-wettable surface of the RHM upper layer 35, but forms a deeper pool, e.g., about 25–60 mm thick, in the recesses 36 above the top 10 of the carbon bars 5, which protects the carbon from attack by the electrolyte. Above the molten aluminum 6 is a layer of molten electrolyte 7 in which the anodes 9 dip. Typically two rows of anodes 9 are arranged side-by-side with any suitable number of anodes along the cell length according to the cell capacity. Advantageously, as shown, the anodes 9 will be non consumable oxygen-evolving anodes, e.g., coated with a cerium oxide-fluoride coating 39. A trough or other arrangement, not shown, is provided at the sides and/or ends of the cell for containing and tapping off the produced aluminum.

We claim:

1. A cell for the electrowinning of aluminum from molten salts having a plurality of anodes disposed over a cell bottom comprising a carbon cathode through which current is supplied to a pool of molten aluminum on the cell bottom, characterized in that the cell bottom is lined with a plurality of sections of carbon and at least one mass of non-conductive, refractory material juxtaposed with the carbon sections to make up a composite cell bottom composed of adjacent areas of current-conducting carbon and non-conducting refractory material, the upper surfaces of the carbon section areas being located at the same level as or lower than the upper surfaces of the refractory areas, and the total upwardly facing surface area of the carbon sections in the cell bottom located under the anodes being smaller than the horizontal surface area of the anodes, with the carbon section areas being placed out of correspondence with the cathodes.

2. A cell according to claim 1, in which the refractory mass occupies at least 30% of the surface area of the cell bottom.

3. A cell according to claim 1, in which the refractory mass extends to the cell sides.

4. A cell according to claim 1, in which the refractory mass comprises tabular alumina.

5. A cell according to any of claim 1, in which at least part of the refractory mass consists of fused alumina.

6. A cell according to claim 1, in which the surface of the refractory mass is wettable by molten aluminum.

7. A cell according to claim 1, in which the level of the refractory mass is the same as the level of the carbon cathode.

8. A cell according to claim 1, in which the level of the refractory mass is higher than the level of the carbon cathode.

9. A cell according to claim 8, in which the pool of aluminum above the refractory mass has a minimum level above the carbon cathode such that the level of molten aluminum maintained permanently is sufficient to protect the carbon from contact with the electrolyte during fluctuations of the pool level above the refractory mass.

10. A cell according to claim 1, in which the carbon cathode sections are longitudinal in the cell.

11. A cell according to claim 1, in which the carbon cathode sections are transversal in the cell.

12. A cell according to claim 1, in which the electrical contact of the carbon cathode to external bus bars is made through collector bars extending horizontally through the cell bottom.

13. A cell according to claim 12, in which vertical pins, plates or bars of metal resisting the operating temperature of the cell are inserted in the carbon cathode and connected to the collector bars.

14. A cell according to claim 1, in which vertical pins, plates or bars of metal resisting the operating temperature of the cell are inserted in the carbon cathode and connected to the cell outside shell and from there to the bus bars.

15. A cell according to claim 1, in which the surface of the carbon cathodes in contact with the molten aluminum is increased to improve electrical contact by providing cuts, holes, slots or other recesses in the carbon body extending vertically but not reaching the current collecting means, these cuts, holes, slots or recesses being filled with molten aluminum.

16. A cell according to claim 1, in which spacings are provided between the carbon cathodes and the adjacent refractory mass, these spacings extending vertically and being filled with molten aluminum, but not reaching the current collecting means.

17. A cell according to claim 1, in which the anodes are oxygen evolving anodes.

18. A cell according to claim 17, in which the anodes are dimensionally stable.

19. A cell for the electrowinning of aluminum from molten salts having a plurality of anodes disposed over a cell bottom comprising a carbon cathode through which current is supplied to a pool of molten aluminum on the cell bottom, characterized in that the cell bottom is lined with at least one body of carbon and at least one mass of non-conductive, refractory material juxtaposed with the carbon body or bodies to make up a composite cell bottom composed of adjacent areas of current-conducting carbon and non-conducting refractory material, the upper surfaces of the carbon areas being located at the same level as or lower than the upper surfaces of the refractory areas, with the total upwardly facing surface area of the carbon in the cell bottom located under the anodes being smaller than the horizontal surface area of the anodes, and with the electrical contact of the carbon cathode to external bus bars being made through collector bars extending horizontally through the cell bottom, while vertical pins, plates or bars of metal resisting the operating temperature of the cell are inserted in the carbon cathode and connected to the collector bars.

20. A cell for the electrowinning of aluminum from molten salts having a plurality of anodes disposed over a cell bottom comprising a carbon cathode through which current is supplied to a pool of molten aluminum on the cell bottom, characterized in that the cell bottom is lined with at least one body of carbon and at least one mass of non-conductive, refractory material juxtaposed with the carbon body or bodies to make up a composite cell bottom composed of adjacent areas of current-conducting carbon and non-conducting refractory material, the upper surfaces of the carbon areas being located at the same level as or lower than the upper surfaces of the refractory areas, with the total upwardly facing surface area of the carbon in the cell bottom located under the anodes being smaller than the horizontal surface area of the anodes, and with vertical pins, plates or bars of metal resisting the operating temperature of the cell being inserted in the carbon cathode and connected to a cell outside shell and from there to bus bars.

21. A cell for the electrowinning of aluminum from molten salts having a plurality of anodes disposed over a cell bottom comprising a carbon cathode through which current is supplied to a pool of molten aluminum on the cell bottom, characterized in that the cell bottom is lined with at least one body of carbon and at least one mass of non-conductive, refractory material juxtaposed with the carbon body or bodies to make up a composite cell bottom composed of adjacent areas of current-conducting carbon and non-conducting refractory material, the upper surfaces of the carbon areas being located at the same level as or lower than the upper surfaces of the refractory areas, with the total upwardly facing surface area of the carbon in the cell bottom located under the anodes being smaller than the horizontal surface area of the anodes, and with the surface of the carbon cathode in contact with the molten aluminum being increased to improve electrical contact by providing cuts, holes, slots or other recesses extending vertically but not reaching current collecting means, these cuts, holes, slots or recesses being filled with molten aluminum.

22. A cell according to claim 21, in which said recesses are provided between the carbon cathodes and the adjacent refractory mass, these recesses extending vertically and being filled with molten aluminum, but not reaching the current collecting means.

23. A cell according to claim 19, 20 or 21, in which the carbon cathode consists of a plurality of sections and the carbon cathode sections in the cell are placed under the anodes, or the carbon cathode sections in the cell are placed out of correspondence with the anodes.

24. A method of electrowinning aluminum from a molten salt in a cell having a plurality of anodes disposed over a cell bottom comprising a carbon cathode through which current is supplied to a pool of molten aluminum on the cell bottom, said method being characterized by lining the cell bottom with a plurality of sections of carbon and at least one mass of non-conductive, refractory material juxtaposed with the carbon sections to make up a composite cell bottom composed of adjacent areas of current-conducting carbon and non-conducting refractory material, positioning the upper surfaces of the carbon sections at the same level as or lower than the upper surfaces of the refractory areas, supplying sufficient of said carbon sections to provide a total upwardly facing surface area of the carbon sections in the cell bottom that is smaller than the horizontal surface area of the overlying anodes, and passing current from said carbon sections of smaller surface area.

25. The method of claim 24, wherein said current is passed in a cell renovated by replacing some used blocks of carbon with new blocks of carbon, while replacing some used blocks of carbon with said non-conductive, refractory material.

26. A cell for the electrowinning of aluminum from molten salts having a plurality of anodes disposed over a cell bottom comprising a carbon cathode through which current is supplied to a pool of molten aluminum on the cell bottom, characterized in that the cell bottom is lined with a plurality of sections of carbon extending throughout the thickness of the cell bottom and forming the cathode, with said cell bottom having at least one mass of non-conductive, refractory material, juxtaposed with the carbon sections and extending throughout the thickness of said cell bottom, said carbon sections and said juxtaposed refractory material forming a composite cell bottom composed of adjacent areas of current-conducting carbon and non-conducting refractory material, the upper surfaces of the carbon sections being located at the same level as or lower than the upper surfaces of the refractory areas, with the total upwardly facing surface area of the carbon in the cell bottom being smaller than the horizontal surface area of the anodes, and with the carbon section areas being placed out of correspondence with the overlying anodes.

* * * * *